US010544601B2

(12) United States Patent
Van Hoek-Patterson et al.

(10) Patent No.: US 10,544,601 B2
(45) Date of Patent: Jan. 28, 2020

(54) POLE SHIELD

(71) Applicant: RS Technologies Inc., Calgary, Alberta (CA)

(72) Inventors: Shawn Van Hoek-Patterson, Calgary (CA); Mingzong Zhang, Calgary (CA); Howard Elliott, Jackson, MI (US)

(73) Assignee: RS Technologies Inc., Calgary, Alberta (CA)

( * ) Notice: Subject to any disclaimer, the term of this patent is extended or adjusted under 35 U.S.C. 154(b) by 150 days.

(21) Appl. No.: 15/316,055

(22) PCT Filed: May 29, 2015

(86) PCT No.: PCT/CA2015/050497

§ 371 (c)(1),
(2) Date: Dec. 2, 2016

(87) PCT Pub. No.: WO2015/184538

PCT Pub. Date: Dec. 10, 2015

(65) Prior Publication Data

US 2017/0101801 A1 Apr. 13, 2017

Related U.S. Application Data

(60) Provisional application No. 62/006,613, filed on Jun. 2, 2014.

(51) Int. Cl.
*E04H 12/22* (2006.01)
*E02D 5/60* (2006.01)
(Continued)

(52) U.S. Cl.
CPC ..... *E04H 12/2292* (2013.01); *E02D 5/226* (2013.01); *E02D 5/60* (2013.01);
(Continued)

(58) Field of Classification Search
None
See application file for complete search history.

(56) References Cited

U.S. PATENT DOCUMENTS 837,820 A * 12/1906 Folsom et al. ..... 52/168
1,521,285 A 12/1924 Erickson
(Continued)

FOREIGN PATENT DOCUMENTS

WO WO 2006/081679 8/2006
WO WO 2006/081685 8/2006

OTHER PUBLICATIONS

The AlphaGen A-1 Fire Wrap; AlphaGen Materials Technology Inc.; Website: www.slideserve.com; Jul. 16, 2014; pp. 1-12.
(Continued)

*Primary Examiner* — Robert Canfield
(74) *Attorney, Agent, or Firm* — Stites & Harbison PLLC; Richard S. Myers, Jr.

(57) ABSTRACT

The present disclosure relates to a pole shield for extending around a pole structure. The pole shield comprises a sheet of composite material forming a hollow structure having an open first end and an opposed open second end. The sheet of composite material comprises from about 0% to about 80% by weight of a reinforcement impregnated with about 20% to about 50% of a polyurethane resin composition comprising a combination of a polyol component and a polyisocyanate component. Two or more pole shields may be stacked one on top of the other to form a pole shield structure which extends the height of protection of the pole structure. The pole shield can be used for protecting a pole structure from damage, such as from fire, rain, wind, sand, ice, pests, moisture or electrical. The pole shield may also be used to provide structural support to a pole structure.

23 Claims, 6 Drawing Sheets

(51) Int. Cl.

| | |
|---|---|
| ***E02D 5/64*** | (2006.01) |
| ***E02D 5/22*** | (2006.01) |
| ***E04B 1/66*** | (2006.01) |
| ***E04B 1/72*** | (2006.01) |
| ***E02D 27/42*** | (2006.01) |

(52) U.S. Cl.
CPC ..... *E02D 5/64* (2013.01); *E02D 27/42* (2013.01); *E04B 1/66* (2013.01); *E04B 1/665* (2013.01); *E04B 1/72* (2013.01); *E02D 2300/0014* (2013.01); *E02D 2300/0017* (2013.01)

(56) References Cited

U.S. PATENT DOCUMENTS 2,724,156 A * 11/1955 Shaw ..... E04H 12/2292 52/168
2,843,890 A * 7/1958 Cater ..... A01M 1/18 405/216
3,177,667 A * 4/1965 Liddell ..... E02D 5/60 405/216
3,321,924 A * 5/1967 Liddell ..... E02D 5/60 138/110
3,890,795 A * 6/1975 Maurer ..... E02D 5/60 24/197
4,023,374 A * 5/1977 Colbert ..... E02D 5/64 138/159
4,131,703 A 12/1978 Voet
4,244,156 A * 1/1981 Watts, Jr. ..... E02D 5/226 264/46.5
4,702,057 A * 10/1987 Phillips ..... E04H 12/2292 52/170
4,799,340 A * 1/1989 Lichau ..... E04H 12/2292 405/255
4,818,148 A * 4/1989 Takeda ..... E02D 5/60 405/216
4,822,659 A 4/1989 Anderson et al.
5,083,408 A 1/1992 Blom et al.
5,138,806 A * 8/1992 Marx ..... B27K 3/0235 106/18.3
5,175,032 A * 12/1992 Steele ..... B29C 61/10 138/104
5,232,976 A 8/1993 Horacek et al.
5,311,713 A 5/1994 Goodrich et al.
5,423,150 A 6/1995 Hitchcock et al.
5,435,667 A * 7/1995 Strange ..... E02D 5/64 405/211
5,516,236 A * 5/1996 Williams ..... E02D 5/60 405/211
5,542,229 A * 8/1996 Saito ..... E04H 12/2292 52/745.17
5,733,613 A * 3/1998 Baecker ..... B29C 63/42 156/86
5,746,031 A * 5/1998 Burns ..... A62C 2/00 248/519
6,016,889 A 1/2000 Pearcy et al.
6,074,714 A 6/2000 Gottfried et al.
6,098,351 A * 8/2000 Mills ..... E04H 12/2292 52/169.14
6,136,883 A * 10/2000 Yang ..... B29C 70/34 427/220
6,176,062 B1 * 1/2001 Fayle ..... E01F 15/0469 405/216
6,364,575 B1 * 4/2002 Bradley ..... E02B 17/0026 405/216
6,389,760 B1 * 5/2002 McDonnell ..... A63B 71/028 248/156
6,420,493 B1 7/2002 Ryckis-Kite et al.
6,500,555 B1 12/2002 Khaldi et al.
6,706,793 B2 3/2004 Abu-Isa et al.
6,742,305 B2 6/2004 Rogers et al.
7,395,869 B2 7/2008 Schnabel et al.
7,479,513 B2 1/2009 Reinheimer et al.
7,568,528 B1 8/2009 Miller et al.
7,686,094 B2 3/2010 Kleff et al.
8,151,898 B2 4/2012 Merchant et al.
8,256,184 B2 * 9/2012 Lowe ..... E04H 12/2292 52/170
8,533,991 B2 * 9/2013 Lais ..... A01G 13/0243 47/32.4
8,887,452 B2 * 11/2014 Carhart ..... E04H 12/2292 52/169.13
9,085,915 B1 * 7/2015 Emmett ..... E04H 12/2292
2001/0040166 A1 11/2001 Pietrantoni et al.
2002/0095905 A1 7/2002 Fawley et al.
2004/0074199 A1 4/2004 Gordin et al.
2005/0005540 A1 * 1/2005 Nesbitt ..... E04H 12/2292 52/169.9
2006/0088386 A1 4/2006 Ellis et al.
2007/0248805 A1 10/2007 Orologio et al.
2008/0072510 A1 * 3/2008 Wells ..... E04C 3/34 52/251
2008/0274319 A1 * 11/2008 Berksoy ..... E04H 12/02 428/36.91
2010/0270040 A1 * 10/2010 Merchant ..... A62C 3/02 169/45
2012/0011804 A1 * 1/2012 Winterhalter ..... E04H 12/02 52/834
2016/0060892 A1 * 3/2016 Odegard ..... E04H 12/2292 52/835
2017/0254104 A1 * 9/2017 Neighbor ..... E04H 12/08

OTHER PUBLICATIONS

Duropole Fire Proof; Brochure; www.duropole.com; 2015; pp. 1-4.
Osmose Fire Guard Wood Pole Protection; www.osmose.com; 2015; pp. 1-2.
Osmose Fire-Guard, Fire Protective Coating for Wood Utility Poles; www.osmose.com; 2015; pp. 1-2.

* cited by examiner

POLE SHIELD

CROSS REFERENCE TO RELATED APPLICATIONS

This application is a § 371 National State Application of PCT/CA2015/050497 filed May 29, 2015 which claims priority to provisional application no. 62/006,613 filed Jun. 2, 2014.

TECHNICAL FIELD

The present disclosure is directed at a pole shield for installation around a pole structure, such as highway luminaire supports and utility poles for telephone, cable and electricity.

BACKGROUND

Pole structures are used for a variety of purposes, such as, but not limited to, highway luminaire supports and utility poles for telephone, cable and electricity. These pole structures are typically made from materials such as wood, steel or concrete.

Generally with wooden pole structures, the wood is treated to protect the pole structure from insect damage, pest attacks (such as woodpeckers and ants) and any rotting effects from moisture, which can be expensive and time-consuming. Such treatments may also make the pole structure more susceptible to fire, as they generally involve some form of petrochemical, which is impregnated into the wood of the pole structure. Other types of pole structures, such as steel and concrete pole structures may also be susceptible to environmental damage, such as fire. Older pole structures made of any material may require extra structural support. Further, with some electrical steel poles, electrical insulating material may need to be provided at the point where the steel pole exists the ground in order to protect people touching the pole structure in the event of a ground fault. If these types of pole structures are damaged and are no longer functional, this can cause a service interruption to consumers, such as to those consumers travelling on highways and those who rely on these pole structures for providing telephone, cable and electricity services. It can be expensive and time consuming to replace such pole structures.

U.S. Pat. No. 8,151,898 to Merchant (hereinafter referred to as "Merchant") descries a wildfire suppressor that is cylindrically shaped so that it wraps around a wooden utility pole. The fire suppressor of Merchant comprises two layers, with the first layer including a ceramic material for reflecting heat and the second layer containing a graphite compound that expands when heated to a certain temperature thereby becoming a poor conductor of heat. The first layer is located on the outer portion of the sheet and the second layer is located closer to the object being protected.

SUMMARY

According to a first aspect, there is provided a pole shield comprising a sheet of composite material forming a hollow structure having an open first end and an opposed open second end for circumferentially extending around a pole structure. The sheet of composite material comprises from about 50% to about 80% by weight of a reinforcement impregnated with about 20% to about 50% of a polyurethane resin composition comprising a combination of a polyol component and a polyisocyanate component.

The reinforcement may be glass. The polyol component may comprise a plurality of OH groups that are reactive towards the polyisocyanate component and the polyisocyanate component may comprise a plurality of NCO groups that are reactive towards the polyol component. The OH:NCO mixing ratio, by volume, of the polyurethane resin composition may be from about 1.0:5.0 to about 5.0:1.0. The polyol component may comprise a polyether polyol, a polyester polyol, or a mixture thereof. The polyisocyanate component may comprise an aromatic isocyanate, an aliphatic isocyanate, or a mixture thereof.

The sheet of composite material may be from about 0.2 mm to about 20.0 mm thick. The sheet of composite material may comprise a plurality of layers. The sheet of composite material may comprises between 2 and 12 layers. The sheet of composite material may include an opening extending from the first end to the second end and the sheet of composite material may be movable between a receiving position where the opening is expanded to receive the pole structure and a closed position where the opening is reduced and the sheet of composite material circumferentially extends around the pole structure. The sheet of composite material may be biased in the closed position. In the closed position a portion of the sheet of composite material may overlay another portion of the sheet of composite material.

The hollow structure may be a cylindrical tube and the cross-sectional areas of the open first end and the open second end are substantially the same. The hollow structure may be a tapered tube and the cross-sectional area of the open first end may be less than a cross-sectional area of the open second end.

According to another aspect, there is provided a pole shield structure comprising two or more pole shields according to the first aspect stacked one on top of the other with the open first end of a first of the pole shields connecting to the open second end of a second of the pole shields to increase the height of the pole shield extending around the pole structure.

The open first end of the first pole shield may overlap with the open second end of the second pole shield. The open first end of the first pole shield may be received within the open second end of the second pole shield. The open second end of the second pole shield may be received within the open first end of the first pole shield. The open first end of the first pole shield may be connected to the open second end of the second pole shield by a fastener.

The first pole shield may have a greater internal dimension than an external dimension of the second pole shield such that at least a portion of the second pole shield nests within the first pole shield when the pole shield structure is unassembled.

According to another aspect, there is provided a kit for constructing a pole shield structure comprising two or more pole shields according to the first aspect.

A first of the pole shields may have a greater internal dimension than an external dimension of a second of the pole shields, such that at least a portion of the second pole shield nests within the first pole shield.

This summary does not necessarily describe all features of the present invention. Other aspects, features and advantages of the present disclosure will become apparent to those of ordinary skill in the art upon review of the following description of specific embodiments of the invention.

BRIEF DESCRIPTION OF THE DRAWINGS

These and other features of the invention will become apparent from the following description in which reference is made to the appended drawings, the drawings are for the purpose of illustration only and are not intended to in any way limit the scope to the particular embodiment or embodiments shown, wherein:

FIG. 7A shows half of the pole shield embedded in the ground and half of the pole shield extending above ground; FIG. 7B shows the pole shield partially embedded in the ground with the remaining portion of the pole shield extending above ground; and FIG. 7C shows the pole shield positioned above ground only from the point where the pole structure exits the ground.

FIG. 8A shows two of the tapered pole shields of FIG. 2 stacked one on top of the other to extend the pole shield structure to a selected height around the pole structure; and where FIG. 8B shows three of the tapered pole shields of FIG. 2 stacked one on top of the other to extend the pole shield structure to a selected height around the pole structure.

DETAILED DESCRIPTION

Directional terms such as "top," "bottom" and "vertical" are used in the following description for the purpose of providing relative reference only, and are not intended to suggest any limitations on how any article is to be positioned during use, or to be mounted in an assembly or relative to an environment.

The present disclosure relates to a pole shield for installation around a pole structure, such as highway luminaire supports and utility poles for telephone, cable and electricity. The pole structure is designed to protect the pole structure from damage, such as insect damage, pest attack, the rotting effects from moisture, UV damage and to provide structural support and fire resistance.

Figure 1:
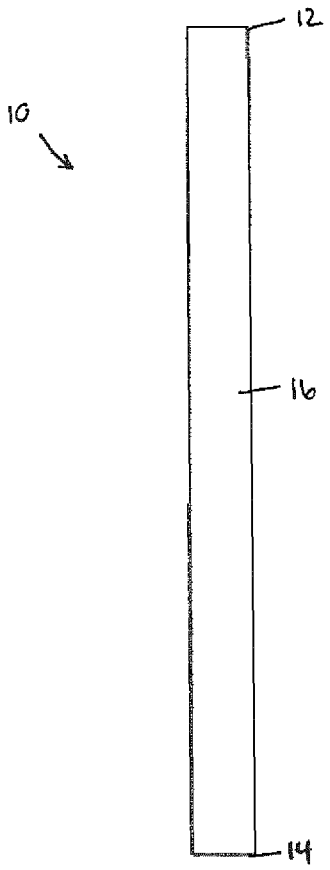
FIG. 1 is a side elevation view of a cylindrical pole shield in accordance with embodiments of the invention.
Figure 2:
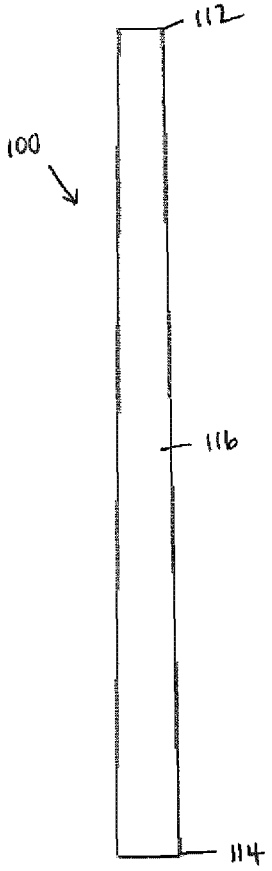
FIG. 2 is a side elevation view of a tapered pole shield in accordance with embodiments of the invention.
Figure 3:
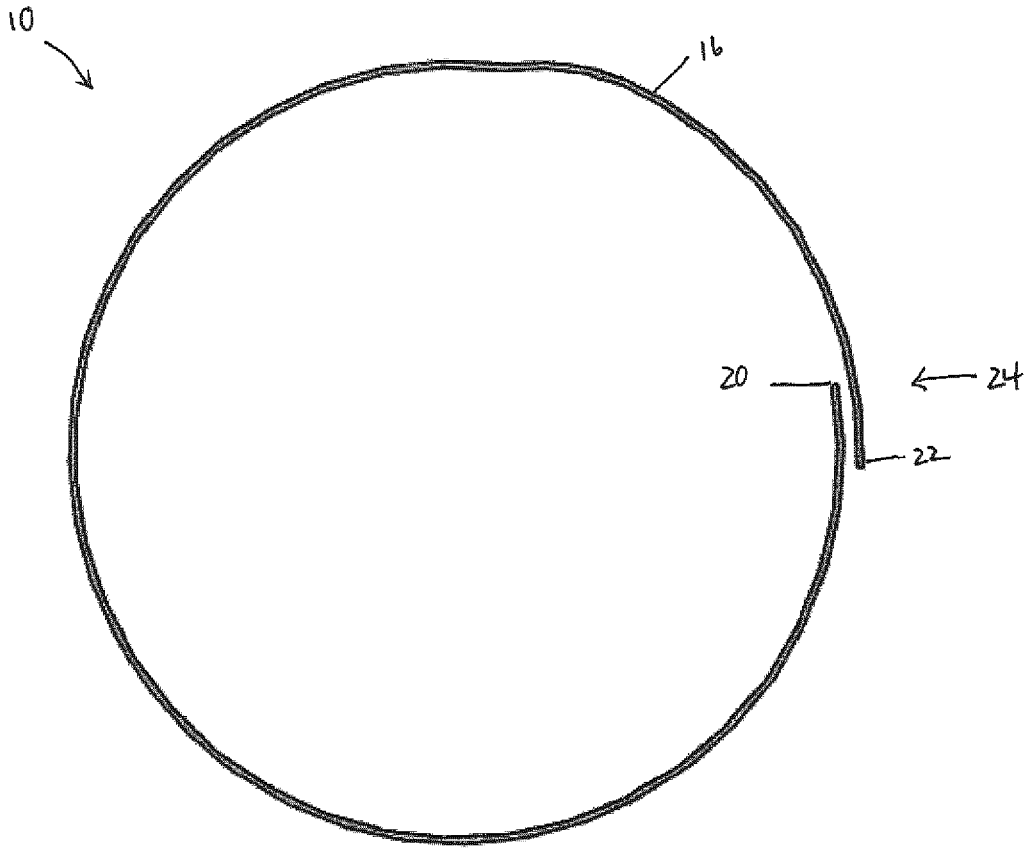
FIG. 3 is a top plan view of the embodiment of the pole shield of FIG. 1.

Referring now to FIGS. 1, 2, and 3, there is shown a pole shield 10, 100, for installation around a pole structure. Pole shield 10 of FIGS. 1 and 3 is cylindrically shaped and pole shield 100 of FIG. 2 is tapered. Both pole shield 10 and pole shield 100 comprise a sheet of composite material (16 and 116 respectively) having a top (or first) end (12 and 112, respectively) and an opposed bottom (or second) end (14 and 114, respectively). The sheet of composite material 16, 116 is biased to form a hollow tubular structure with open top end 12, 112 and open bottom end 14, 114. With the tapered pole shield 100, the top end 112 has a diameter less than the bottom end 114 to provide pole shield 100 with its tapered shape. With cylindrical pole shield 10, the diameter of the top end 12 is the same as the diameter of the bottom end 14. In alternative embodiments, the sheet of composite material may form a different shape, for example, but not limited to, oval, polygonal, or other shapes with a non-circular cross-section, such as, without limitation, square, triangular or rectangular or any other shape that forms a hollow structure which can be installed around a pole structure.

The sheet of composite material 16, 116 comprises reinforcement impregnated with a polyurethane resin. The polyurethane resin holds the reinforcement to form the desired shape while the reinforcement generally improves the overall mechanical properties of the polyurethane resin. The composite material comprises about 20-50% by weight of the polyurethane resin, or any amount therebetween, for example, 22, 24, 26, 28, 30, 32, 34, 36, 38, 40, 42, 44, 46, 48%, or any amount therebetween, by weight of the polyurethane resin, and comprises about 50-80% by weight of the reinforcement, or any amount therebetween, for example, 52, 54, 56, 58, 60, 62, 64, 66, 68, 70, 72, 74, 76, 78%, or any amount therebetween, by weight of the reinforcement.

By the term "reinforcement," it is meant a material that acts to further strengthen the polyurethane resin of the composite material, such as, for example, but not limited to, fibers, particles, flakes, fillers, or mixtures thereof. The reinforcement generally improves the overall mechanical properties of the polyurethane resin. Reinforcement typically comprises glass, carbon, or aramid; however, there are a variety of other reinforcement materials that can be used, as would be known to one of skill in the art. These include, but are not limited to, synthetic and natural fibers or fibrous materials, for example, but not limited to polyester, polyethylene, quartz, boron, basalt, ceramics and natural reinforcement, such as fibrous plant materials, for example, jute and sisal.

The polyurethane resin composition comprises a polyol component and a polyisocyanate component. The polyurethane resin composition may be a thermosetting resin composition which is a liquid reaction mixture used to impregnate the reinforcement and is then set or cured to provide a substantially solid matrix for the reinforcement. Other additives may also be included in the polyurethane resin composition, such as fillers, pigments, plasticizers, curing catalysts, UV stabilizers, antioxidants, microbiocides, algicides, dehydrators, thixotropic agents, wetting agents, flow modifiers, matting agents, deaerators, extenders, molecular sieves for moisture control and desired colour, UV absorber, light stabilizer, moisture absorbents, fire retardants and release agents.

By the term "polyol component" it is meant a composition that contains a plurality of active hydrogen or OH groups that are reactive towards the polyisocyanate component under the conditions of processing. The polyol component of the polyurethane resin composition may comprise polyether polyols and polyester polyols. Polyols described in U.S. Pat. No. 6,420,493 (which is incorporated herein by reference) may also be used in the polyurethane resin composition described herein. The polyol component may include, but is not limited to, a polyether polyol, a polyester polyol, or a mixture thereof. The polyester polyol may be, but is not limited to a diethylene glycol-phthalic anhydride based polyester polyol. The polyether polyols may be, but is not limited to, polyoxyalkylene polyol, propoxylated glycerol, branched polyol with ester and ether groups, amine initiated-hydroxyl terminated polyoxyalkylene polyol and mixtures thereof.

By the term "polyisocyanate component" it is meant a composition that contains a plurality of isocyanate or NCO groups that are reactive towards the polyol component under the conditions of processing. The polyisocyanate component of the polyurethane resin composition may comprise aromatic isocyanate, aliphatic isocyanate or the mixture of aromatic isocyanate and aliphatic isocyanate. Polyisocyanates described in U.S. Pat. No. 6,420,493 may also be used in the polyurethane resin composition described herein.

By the term "aliphatic isocyanate" it is meant an isocyanate in which NCO groups are either attached to an aliphatic center or not attached directly to an aromatic ring. It is also within the scope of the present invention that the term "aliphatic isocyanate" means an isocyanate in which the NCO groups are attached to an aliphatic center. Aliphatic isocyanates described in U.S. Pat. No. 6,420,493 may be used in the resin compositions described herein. Aliphatic isocyanates may include, but are not limited to, hexamethylene diisocyanate (HDI), isophorone diisocyanate (IPDI), dicyclohexane-4,4' diisocyanate (Desmodur W), hexamethylene diisocyanate trimer (HDI Trimer), isophorone diisocyanate trimer (IPDI Trimer), hexamethylene diisocyanate biuret (HDI Biuret), cyclohexane diisocyanate, meta-tetramethylxylene diisocyanate (TMXDI), and mixtures thereof. The aliphatic isocyanate may include a polymeric aliphatic diisocyanate, for example, but not limited to a uretidione, biuret, or allophanate polymeric aliphatic diisocyanate, or a polymeric aliphatic diisocyanate in the symmetrical or asymmetrical trimer form, or a mixture thereof, which typically does not present a toxic hazard on account of extremely low volatility due to very low monomer content. The aliphatic isocyanates may be hexamethylene diisocyanate (HDI), isophorone diisocyanate (IPDI) or a mixture thereof, and may be a mixture of aliphatic hexane 1,6-diisocyanato-homopolymer and hexamethylene diisocyanate (HDI). Hexamethylene diisocyanate polyisocyanates described in EP-A 668 330 to Bayer AG; EP-A 1 002 818 to Bayer AG; and WO 98/48947 to Valspar Corp (which are incorporated herein by reference) may be used in the aliphatic isocyanate resin composition described herein.

By the term "aromatic isocyanate" it is meant an isocyanate in which NCO groups are attached to an aromatic ring. Aromatic isocyanates described in U.S. Pat. No. 6,420,493 may be used in the resin composition described herein. Aromatic isocyanates may include, but are not limited to, methylene di-p-phenylene isocyanate, polymethylene polyphenyl isocyanate, methylene isocyanatobenzene or a mixture thereof. The aromatic polyisocyanate may include from about 30% to about 60% by weight, or any amount therebetween, of methylene di-p-phenylene isocyanate, from about 30% to about 50% by weight, or any amount therebetween of polymethylene polyphenyl isocyanate, with a balance of methylene isocyanatobenzene.

The polyurethane resin composition may have a OH:NCO mixing ratio, by volume, from about 1.0:5.0 to about 5.0:1.0, or any amount therebetween, for example a mixing ratio of 1.0:4.0, 1.0:3.0, 1.0:2.0, 1.0:1.0, 2.0:1.0; 3.0:1.0, 4.0:1.0 or any ratio therebetween.

The present disclosure also contemplates the addition of an aliphatic polyurethane composite material top coat or other suitable material to enhance durability and service life of the pole shield 10, 100. Such materials may be useful for providing a tougher outer surface that is extremely resistant to weathering, ultraviolet (UV) light, abrasion and can be coloured for aesthetics or identification. An aliphatic isocyanate thermosetting polyurethane resin may be used in a top coat or outer layer(s) of the sheet of composite material 16, 116. The aliphatic isocyanate thermosetting polyurethane resin top layer may have a higher concentration of aliphatic isocyanate than the thermosetting polyurethane resin used for the remainder of the pole shield. Aliphatic isocyanates polyurethane resin has superior resistance to weathering and UV rays, however aliphatic isocyanate resin is generally more expensive than other resins, such as aromatic polyisocyanate polyurethane resin. A pole shield having one or more outer layers of an aliphatic isocyanate polyurethane composite material and an inner core made from a different composite material with a lower concentration of aliphatic isocyanate therein beneficially possesses UV stability and superior abrasion resistance, while being less expensive to produce than a pole shield manufactured with a homogenous distribution of aliphatic isocyanate polyurethane throughout the pole shield.

The sheet of composite material 16, 116 may include a slit or opening which extends longitudinally from the top end 12 to the bottom end 14. The sheet of composite material 16, 116 is sufficiently flexible that the opening can be expanded to enable the pole shield 10, 100 to be installed around a pole structure that is already mounted in or on the ground. The sheet 16, 116 is then closed by reducing the opening. In the embodiment shown in FIG. 3, the sheet of composite material 16 has a first portion 20 and second portion 22 which overlap, forming an overlapping portion 24 of the sheet of composite material. As would be understood by those skilled in the art, overlapping portion 24 helps to ensure that pole shield 10 completely extends around a particular pole structure and also provides an area where the overlapping composite material can be secured together to form a hollow tubular structure or other hollow-shaped structure. Overlapping portion 24 allows for size variation in a pole structure due to swelling and contracting of the pole structure, as may happen with wooden pole structures. The overlapping potion 24 further allows the pole shield 10 to be used on a variety of pole structures with different outer circumferences as the internal dimensions of the pole shield can be expanded or contracted as required. In the embodiment shown in FIG. 3, the sheet of composite material 16 is biased to a tubular shape so that it returns to this tubular shape after being opened and positioned around a tubular pole structure. One of skill in the art, however, will appreciate that the composite material is of suitable flexibility that the sheet of composite material may be manipulated to conform to any appropriate shape to envelope pole structures of differing outer shapes and sizes.

The sheet of composite material 16, 116 may be manufactured using filament winding, which is a well-known process for the production of composites. However, other methods may also be used to produce the sheet of composite material 16, 116, such as, but not limited to, pultrusion, resin injection molding, resin transfer molding and hand lay-up forming applications. A typical filament winding process is described in CA 2,444,324 and CA 2,274,328 (both of which are incorporated herein by reference). Fibrous reinforcement, as described herein, for example, but not limited to glass, carbon, or aramid, is impregnated with the polyurethane resin described herein, and wound onto an elongated mandrel, which may be cylindrical or tapered to produce sheet of composite material 16, 116 respectively. Different shaped mandrels may also be used to produce pole shields having different shapes, such as rectangular, triangular and the like.

The resin impregnated reinforcement may be wound onto the mandrel in a predetermined sequence. This sequence may involve winding layers of the composite material at a series of angles ranging between 0° and 90°, or any amount therebetween, relative to the mandrel axis, for example, at an angle of 5°, 10°, 15°, 20°, 25°, 30°, 35°, 40°, 45°, 50°, 55°, 60°, 65°, 70°, 75°, 80°, 85°, or any amount therebetween. The direction that the reinforcement is laid onto the mandrel may affect the eventual strength and stiffness of the finished pole shield. Other factors that may affect the structural properties of the manufactured pole shield include varying the amount of reinforcement to resin ratio, the wrapping sequence, the wall thickness, the type of reinforcement (such as glass, carbon, aramid), and the ratio of the polyol component to the polyisocyanate component (the OH:NCO ratio) of the polyurethane resin composition. The structural properties of the pole shield can be engineered to meet specific performance criteria. In this way, the construction of the sheet of composite material can be configured to produce a finished pole shield that is extremely strong and of a suitable flexibility for installation around a pole structure.

Once the resin has set or cured, the sheet of composite material 16, 116 may be removed from the mandrel and slit longitudinally along its length to create pole shield 10 or 100 for circumferentially extending around the outer surface of a pole structure (as shown in FIG. 3). Alternatively, the longitudinal cutting may be performed while the cured sheet of composite material 16, 116 is still on the mandrel.

The sheet of composite material 16, 116 may be made of a single layer of composite material, such as a layer of composite material laid down by filament winding or extruded by pultrusion. Alternatively, the sheet of composite material 16, 116 may include a plurality of layers of the composite material which are laid down by filament winding or by an alternative process such as pultrusion and bonded or joined together or laid down one on top of the other to form the sheet of composite material 16, 116. The sheet of composite material 16, 116 therefore, comprises one or more than one layer of the composite material, such as, but not limited to, between two to twelve layers of the composite material, for example, 3, 4, 5, 6, 7, 8, 9, 10 or 11 layers. A pole shield made from a plurality of layers of the composite material may beneficially better protect and support the pole structure which it surrounds than a pole shield made from a single layer.

The thickness of the sheet of composite material 16, 116 may vary depending on where, and for what purposes, the pole shield will be used. For example, the sheet of composite material 16, 116 may be about 0.2 mm to about 20.0 mm thick, or any amount therebetween, for example, 0.4, 0.6, 0.8, 1.0, 1.2, 1.4, 1.6, 1.8, 2, 3, 4, 5, 6, 7, 8, 9, 10, 11, 12, 13, 14, 15, 16, 17, 18, 19 mm, or any thickness therebetween.

The sheet of composite material 16, 116 of the pole shield 10, 100 beneficially provides a lightweight structure that generally displays superior strength and durability compared to the strength and durability associated with the wood or steel pole structures around which the pole shield is intended to be installed. The sheet of composite material 16, 116 is also designed to be of sufficient flexibility to conform to the shape of the pole structure that it is installed around. The composite material does not rust like steel and typically does not rot or suffer microbiological or insect attack as is common in wood pole structures. The composite material generally acts as a moisture-shield and protects the underlying pole structure from the effects of moisture damage. Furthermore, the composite material, in contrast to natural products (such as wood), is engineered so the consistency and service life can be closely determined and predicted. Still further, the composite material (or at least the outer layer(s) of the sheet) may be chosen for its fire resistant and/or UV resistant properties.

Figure 4:
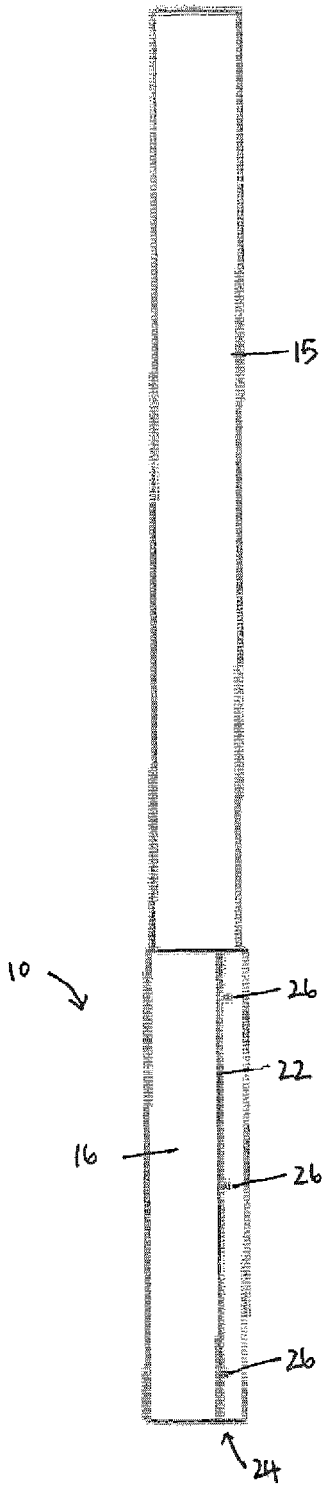
FIG. 4 is a side elevation view of the embodiment of the pole shield of FIG. 1, where the pole shield is installed around a pole structure using screws.
Figure 5:
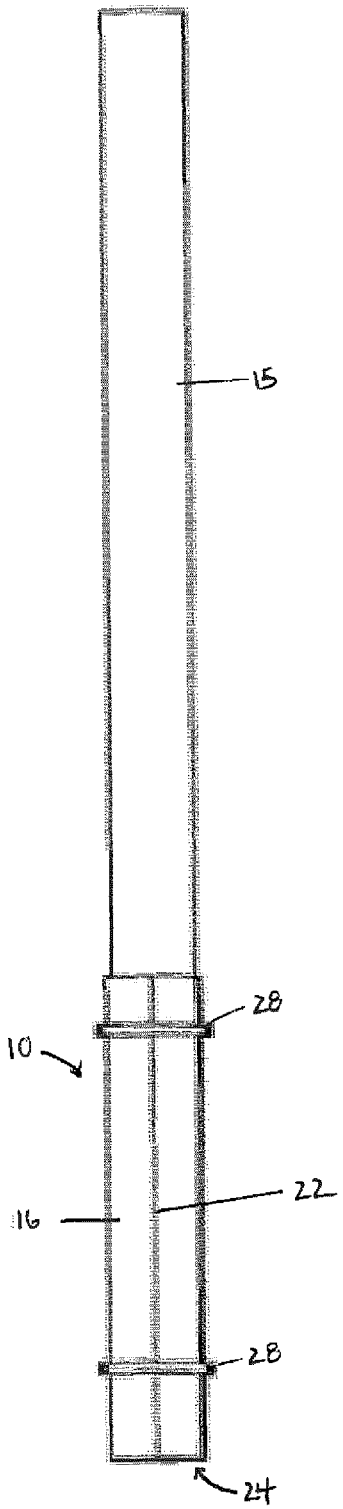
FIG. 5 is a side elevation view of the embodiment of the pole shield of FIG. 1, where the pole shield is installed around a pole structure using bands.
Figure 6:
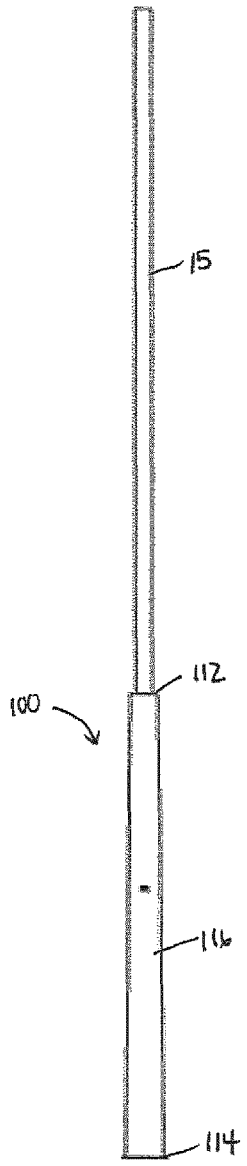
FIG. 6 is a side elevation view of the embodiment of the pole shield of FIG. 2, where the tapered pole shield is installed around a pole structure.

Referring now to FIGS. 4 and 5, there is shown cylindrical pole shield 10 circumferentially extending around a cylindrical pole structure 15. In FIG. 6, there is shown tapered pole shield 100 circumferentially extending around the outer surface of a tapered pole structure 15. In the embodiment shown in FIG. 4, screws 26 are used to secure the overlapping portion 24 of the sheet together to secure the pole shield in position around the pole structure 15. In the embodiment shown in FIG. 5, bands 28 secure pole shield 10 in position around pole structure 15. Any other suitable fastener may be used to secure the pole shield 10 in position around pole structure 15, such as, for example, without limitation, screws, snaps, pins, nails, bolts, adhesives, bands, combinations thereof.

In one embodiment, pole shield 10, 100 circumferentially extends around the outer surface of pole structure 15 such that pole shield 10, 100 is in direct contact with the outer surface of pole structure 15. In such an embodiment, pole shield 10 or 100 may be secured in positioned on the pole structure 15 to provide contact with the structure, using a suitable fastener as described above. In an alternative embodiment, the pole shield 10, 100 may extend circumferentially around the outer surface of pole structure 15 but not actually contact pole structure 15. In this embodiment, there is a gap between the outer surface of pole structure 15 and pole shield 10 or 100, which can be filled with materials to provide further impact resistance to pole structure 15. Materials, such as, without limitation, sand, foam, rocks, gravel, soil or any other suitable material, may be used. Furthermore, such an embodiment of pole shield 10 or 100 may be useful as a casing or structure for holding backfill materials to provide further structural support to pole structure 15.

Figure 7A:
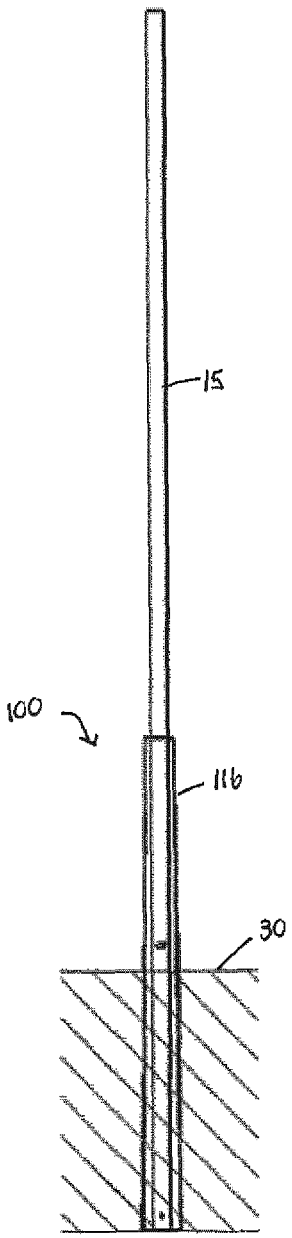
FIGS. 7A, 7B and 7C are side elevation views of the embodiment of the pole shield of FIG. 2 installed around a pole structure, where
Figure 7B:
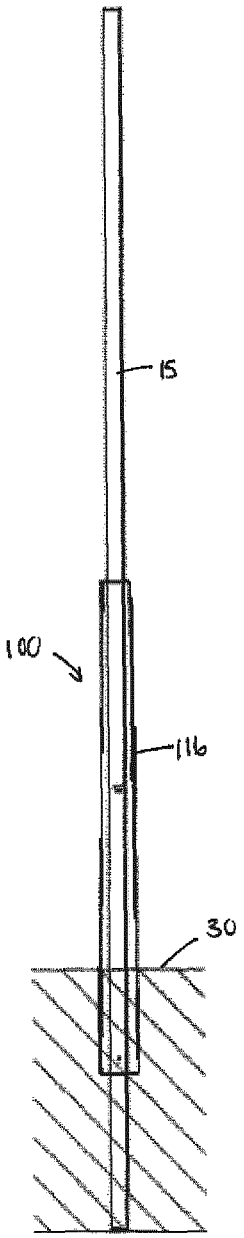
Figure 7C:
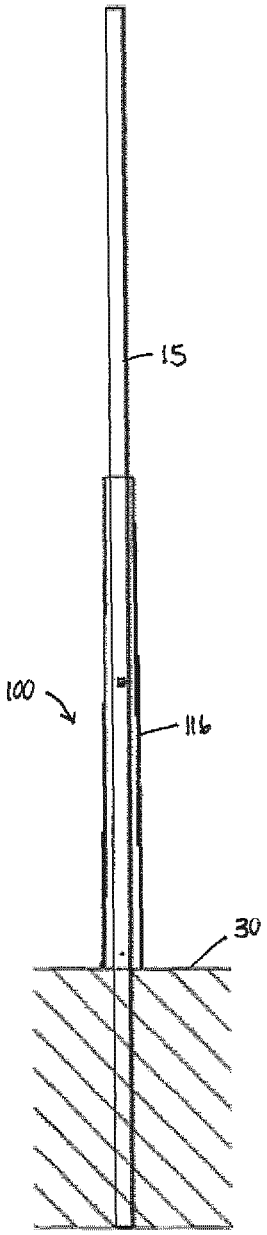

Referring now to FIGS. 7A and 7B, there is shown a portion of the pole shield 100 positioned below the ground surface 30 in order that the pole shield 100 surrounds all or a portion of the underground section of pole structure 15. This may beneficially aid in protection of the underground portion of the pole structure 15 which may be subjected to high moisture and other conditions which can damage the pole structure 15. FIG. 7A shows pole shield 100 extending below ground surface 30 and completely covering the underground section of pole structure 15. The remaining portion of pole shield 100 extends above ground surface 30 and covers the section of pole structure 15 that exits from ground surface 30. FIG. 7B shows pole shield 100 extending below ground surface 30 and only partially covering the underground section of pole structure 15. The remaining portion of pole shield 100 extends above ground surface 30 and covers the section of pole structure 15 that exits from ground surface 30. FIG. 7C shows pole shield 100 above ground only and covering pole structure 15 starting the point that pole structure 15 exits from ground surface 30. Pole shield 100 of FIG. 7C, when installed, rests on the ground surface 30.

Figure 8A:
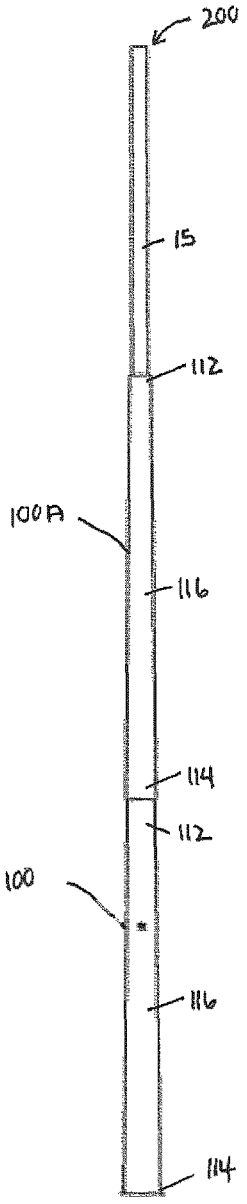
FIGS. 8A and 8B are side elevation views of a pole shield structure in accordance with embodiments of the invention, where
Figure 8B:
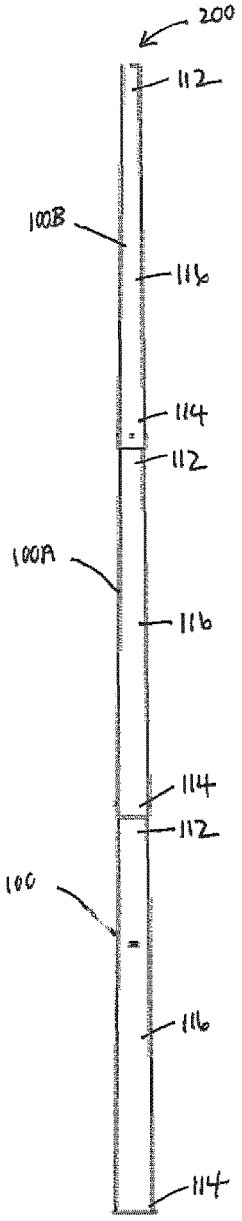

Referring now to FIGS. 8A and 8B, the tapered pole shield 100 may be stacked to form a vertical pole shield stack or structure 200 of a selected height to circumferentially extend around the outer surface of pole structure 15.

Such an embodiment may be particularly useful if pole structure 15 requires extensive structural support, or for protecting the upper portions of pole structure 15 from damage, such as fire, rain, wind, ice, sand, pests (such as larger animals or birds), or if there is grass, shrubs or other types of vegetation in the surrounding area that extend above the height of a single pole shield installed around pole structure 15.

As described above, each tapered pole shield 100 is hollow and has an open top (or first) end 112 and an open bottom (or second) end 114 with the cross-sectional area of top end 112 being less than the cross-sectional area of bottom end 114. To form pole shield stack 200, bottom end 114 of pole shield 100A is mated with top end 112 of pole shield 100 (as shown in FIG. 8A). Pole shield stack 200 can be of any desired height to extend the pole shield to cover all or most of pole structure 15. The height of pole shield stack 200 can be varied simply by adding or removing pole shield(s) 100 from pole shield stack 200. For example, FIG. 8B shows pole shield stack 200 comprising three pole shields 100, 100A, 100B stacked one on top of the other and extending to the top of pole structure 15 such that the entire pole structure 15 is enveloped by pole shield stack 200. More specifically, bottom end 114 of pole shield 100B is mated with top end 112 of pole shield 100A, and bottom end 114 of pole shield 100A is mated with top end 112 of pole shield 100. The resulting pole shield stack 200 has pole shield 100 positioned adjacent to ground surface 30 or embedded in ground surface 30.

The present disclosure therefore contemplates that pole shield 100 be configured such that two or more than two pole shields may be stacked one on top of the other to form a pole shield structure. In one embodiment of the pole shield structure, the top or first end 112 of lower positioned pole shield 100 slips into, or is matingly received within, the bottom or second end of higher positioned pole shield 100A to a predetermined height to provide elongated vertical pole shield stack 200. In an alternative embodiment of the pole shield structure, the bottom or second end 114 of higher positioned pole shield 100A slips into, or is matingly received within the top or first end 112 of lower positioned pole shield 100. The overlaps of these joint areas may be predetermined so that adequate load transfer can take place from one pole shield and the next. This overlap may vary throughout pole shield stack 200, generally getting longer as the pole shields descend in order to maintain sufficient load transfer when reacting against increasing levels of bending moment. The joints may be designed so they provide sufficient load transfer without the use of additional fasteners, for example press fit connections, bolts, metal banding, screws, nails and the like. However, it is within the scope of the present disclosure that a fastener be used to secure two pole shields together, if desired and there may be no overlap of the poles shields in the stack. The internal dimensions of lower positioned pole shield 100 may greater than the external dimensions of higher positioned pole shield 100A such that a portion or the whole of pole shield 100A nests within pole shield 100 when not assembled for ease of transportation and storage.

In alternative embodiments, the cylindrical pole shield 10 or any other shaped pole shield may be stacked one on top of the other and fastened by overlapping and/or through the use of fastener(s). When pole shields are stacked together to form pole shield stack 200, they behave as a single structure able to resist forces and to protect pole structure 15 from damage and to provide structure support to pole structure 15.

As described above, the height of pole shield stack can be varied simply by adding or removing pole shield(s) from pole shield stack.

The present disclosure further provides a series or kit including a plurality of pole shields. The pole shields may be of different sizes. The largest pole shield may have a greater internal dimension than the external dimensions of the next largest pole shield, such that at least a portion of the smaller pole shield nests within the larger pole shield. In one embodiment, the whole of the smaller pole shield nests within the larger pole shield. Additional pole shields may be provided that are gradually smaller in size. In this way, the two or more than two pole shields that make up a pole shield stack 200 can be nested one within the other. The nested pole shields offers handling, transportation and storage advantages due to compactness and space saving.

The series or kit may be used to construct pole shield stack 200 whereby the pole shields may be configured so that the top (or first) end 112 of the first or largest pole shield 100 fits inside or is matingly received within the bottom (or second) end 114 of the second or smaller pole shield 100A. Alternatively, the bottom (or second) end 114 of the second or smaller pole shield 100A may be configured so it will fit inside or is matingly received within the top (or first) end 112 of the first or largest pole shield 100. In alternative embodiments, the kit may include cylindrical pole shields 10 or other different shaped pole shields which can be stacked one on top of the other for construction of a pole shield stack or structure.

Figure 9:
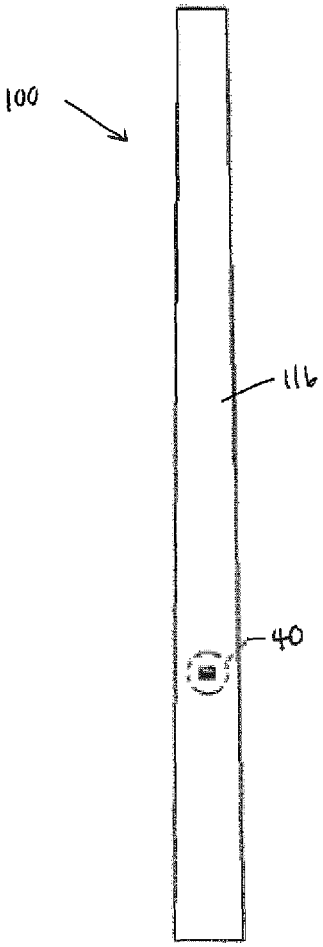
FIG. 9 is a side elevation view of the embodiment of the pole shield of FIG. 2, where the pole shield has an identification (ID) tag.
Figure 10:
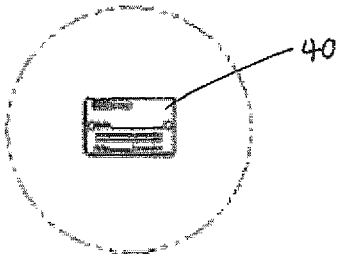
FIG. 10 is a detailed view of the identification (ID) tag of FIG. 9.

Referring now to FIGS. 9 and 10, the pole shield 100 may include an identification (ID) tag 40 on its outer surface that gives information about the pole shield, such as, without limitation, the date of its installation, the date of its last inspection, the date of its next inspection, any parts of the pole shield that require attention or inspection, and any damage to the pole shield. The information may be provided as a bar code which can be easily scanned by a bar code reader so that a large amount of information can be provided by the ID tag 40. Furthermore, as the information can be embedded in a bar code or the like there may be less likelihood that the information on the ID tag will be destroyed by weathering or vandalism. Alternatively, the information may be embossed or printed on the ID tag 40.

In use, therefore (as hereinbefore described), the pole shield of the present disclosure may beneficially protect a pole structure from damage and may also provide additional structural support, especially for leaning or rotting pole structures. The composite material of the pole shield may be selected to include fire suppression qualities. Furthermore, the durability and strength of the composite material may help to support and protect a pole structure from breakage from ice or wind loading. Further, in desert areas, the pole shield may help protect a pole structure from the constant barrage of sand. Still further, the pole shield may help protect a pole structure from moisture, rain, UV damage, bacteria, insects, borers, woodpeckers and other pests, and may thereby reduce the usage of chemicals for treating pole structures. The composite material of the pole shield may also be selected to provide electrical insulation, and therefore can be used as an electrical insulating barrier around steel pole structures. As described above, if the pole shield is positioned away from the outer surface of a pole structure, the gap between the pole structure and the pole shield can be filled in with materials, such as without limitation, sand and foam, to provide impact resistance. Furthermore, with a gap between pole structure and pole shield, the pole shield can be used as a structure or casing for holding backfill materials. The pole shield may also be easier and cheaper to replace if damaged compared to replacing a damaged pole structure, for example, if the pole shield is damaged in a fire, it can be replaced without having to replace the whole pole structure.

While the present invention is illustrated by description of several embodiments and while the illustrative embodiments are described in detail, it is not the intention of the applicants to restrict or in any way limit the scope of the appended claims to such detail. It will be clear to any person skilled in the art that modifications of and adjustments to the foregoing embodiments, not shown, are possible.

The invention in its broader aspects is therefore not limited to the specific details, representative apparatus, and illustrative examples shown and described. Accordingly, departures may be made from such details without departing from the spirit or scope of the general concept.

What is claimed is:

1. A pole shield comprising a sheet of composite material forming a hollow structure having an open first end and an opposed open second end for circumferentially extending around a pole structure, the sheet of composite material comprising from about 50% to about 80% by weight of a reinforcement impregnated with about 20% to about 50% of a polyurethane resin composition comprising a combination of a polyol component and a polyisocyanate component, wherein the sheet of composite material includes an opening extending from the first end to the second end and the sheet of composite material is movable between a receiving position where the opening is expanded to receive the pole structure and a closed position where the opening is reduced and the sheet of composite material circumferentially extends around the pole structure, wherein the composite material is selected for its fire resistant properties, and wherein the hollow structure is a tapered tube and the cross-sectional area of the open first end is less than a cross-sectional area of the open second end.

2. The pole shield of claim 1, wherein the reinforcement is glass.

3. The pole shield of claim 1, wherein the polyol component comprises a plurality of OH groups that are reactive towards the polyisocyanate component and the polyisocyanate component comprises a plurality of NCO groups that are reactive towards the polyol component.

4. The pole shield of claim 3, wherein the OH:NCO mixing ratio, by volume, of the polyurethane resin composition is from about 1.0:5.0 to about 5.0:1.0.

5. The pole shield of claim 1, wherein the polyol component comprises a polyether polyol, a polyester polyol, or a mixture thereof.

6. The pole shield of claim 1, wherein the polyisocyanate component comprises an aromatic isocyanate, an aliphatic isocyanate, or a mixture thereof.

7. The pole shield of claim 1, wherein the sheet of composite material is from about 0.2 mm to about 20.0 mm thick.

8. The pole shield of claim 1, wherein the sheet of composite material is biased in the closed position.

9. The pole shield of claim 1, wherein in the closed position a portion of the sheet of composite material overlays another portion of the sheet of composite material.

10. The pole shield of claim 1, wherein the hollow structure is a cylindrical tube and the cross-sectional areas of the open first end and the open second end are substantially the same.

11. A pole shield structure comprising two or more pole shields wherein each pole shield comprises a sheet of composite material forming a hollow structure having an open first end and an opposed open second end for circumferentially extending around a pole structure, the sheet of composite material comprising from about 50% to about 80% by weight of a reinforcement impregnated with about 20% to about 50% of a polyurethane resin composition comprising a combination of a polyol component and a polyisocyanate component, wherein the sheet of composite material includes an opening extending from the first end to the second end and the sheet of composite material is movable between a receiving position where the opening is expanded to receive the pole structure and a closed position where the opening is reduced and the sheet of composite material circumferentially extends around the pole structure, wherein the composite material is selected for its fire resistant properties, wherein the two or more pole shields are stacked one on top of the other with the open first end of a first of the pole shields connecting to the open second end of a second of the pole shields to increase the height of the pole shield extending around the pole structure.

12. The pole shield structure of claim 11, wherein the open first end of the first pole shield overlaps with the open second end of the second pole shield.

13. The pole shield structure of claim 12, wherein the open first end of the first pole shield is received within the open second end of the second pole shield.

14. The pole shield structure of claim 12, wherein the open second end of the second pole shield is received within the open first end of the first pole shield.

15. The pole shield structure of claim 11, wherein the open first end of the first pole shield is connected to the open second end of the second pole shield by a fastener.

16. The pole shield structure of claim 11, wherein the first pole shield has a greater internal dimension than an external dimension of the second pole shield such that at least a portion of the second pole shield nests within the first pole shield when the pole shield structure is unassembled.

17. A kit for constructing a pole shield structure comprising two or more pole shields of claim 1.

18. The kit of claim 17, wherein a first of the pole shields has a greater internal dimension than an external dimension of a second of the pole shields, such that at least a portion of the second pole shield nests within the first pole shield.

19. A method of protecting a pole structure from fire comprising:

(a) providing a pole shield of claim 1; and (b) expanding the opening and positioning the sheet of composite material circumferentially around the pole structure.

20. The method of claim 19, wherein the pole structure is a utility pole already mounted in the ground.

21. The method of claim 19, wherein the sheet of composite material is biased in a closed position in which the sheet of composite material circumferentially surrounds the pole structure.

22. The method of claim 21, wherein in the closed position a portion of the sheet of composite material overlays another portion of the sheet of composite material.

23. The method of claim 19, further comprising securing the sheet of composition material in position around the pole structure.

* * * * *